US005471236A

United States Patent [19]

Ito

[11] Patent Number: 5,471,236

[45] Date of Patent: Nov. 28, 1995

[54] MULTI-BEAM SCAN OPTICAL SYSTEM

[75] Inventor: Masao Ito, Kanagawa, Japan

[73] Assignee: Fuji Xerox Co., Ltd., Tokyo, Japan

[21] Appl. No.: 934,314

[22] Filed: Aug. 25, 1992

Related U.S. Application Data

[63] Continuation-in-part of Ser. No. 842,712, Feb. 27, 1992.

[30] Foreign Application Priority Data

| | | | |
|---|---|---|---|
| Feb. 28, 1991 | [JP] | Japan | 3-034374 |
| Jun. 28, 1991 | [JP] | Japan | 3-158608 |
| Aug. 26, 1991 | [JP] | Japan | 3-214000 |

[51] Int. Cl.[6] ..... B41J 2/455

[52] U.S. Cl. ..... 347/233; 347/238; 347/241

[58] Field of Search ..... 346/107 R, 108; 372/24; 347/234, 238, 241, 243, 244, 233

[56] References Cited

U.S. PATENT DOCUMENTS

| | | | |
|---|---|---|---|
| 4,530,574 | 7/1985 | Scifres et al. | 359/668 |
| 4,878,066 | 10/1989 | Shiraishi | 346/108 |

OTHER PUBLICATIONS

"Optics Four Academies," the 6th Color Optics Conference Paper Collection, 1989, pp. 77–80.

Yariv, Amnon, *Optical Electronics,* Saunders College Publishing, Orlando, Fla., 1991, pp. v–xiii and 46–53.

*Primary Examiner*—Benjamin R. Fuller
*Assistant Examiner*—David Yockey
*Attorney, Agent, or Firm*—Finnegan, Henderson, Farabow, Garrett & Dunner

[57] ABSTRACT

A multi-beam scan optical system for writing image information. The system includes a laser array having a plurality of laser diodes, a collimate lens for collimating a plurality of laser beams output from the laser diodes, and an optical member for focusing the collimated laser beams. An aperture is disposed at a position where optical axes of the plurality of laser beams cross an optical axis of the optical member. The system includes a relationship between a distance $r_1$ of separation of the laser diodes, a divergence angle θ, of each of the laser beams, a wavelength λ of each of the laser beams, and an interlace scanning period i, wherein these values satisfy the relation:

$$K=\frac{4}{\pi}\ \alpha\ \frac{i\lambda}{r_1\theta_1}$$

where K is a number in a range from 1.0 to 1.8. The value α depends on the diameter of the aperture as viewed in a subsidiary scan direction and satisfies the relation:

$$d_2=(4\alpha/\pi)(\lambda f_2/D)$$

where π is a circular constant, $f_2$ indicates a focal distance of a first subsidiary-scan directional power optical member, D indicates a diameter in which the intensity is at least $1/e^2$ times the maximum intensity of each of the collimated laser beams entering the aperture, where $1/e^2$ is a constant, and $d_2$ indicates a spot diameter in the subsidiary scan direction of each of the laser beams which are focused on facets of a rotating polygon mirror.

4 Claims, 12 Drawing Sheets

FIG. 10

○ COMBINATIONS OF i AND n TO SATISFY INTERLACED SCANNING CONDITIONS

| INTERLACED SCANNING PERIOD (i) | | | | | | | | | |
|---|---|---|---|---|---|---|---|---|---|
| 9 | | ○ | × | ○ | ○ | × | ○ | ○ | × |
| 8 | | × | ○ | × | ○ | × | ○ | × | ○ |
| 7 | | ○ | ○ | ○ | ○ | ○ | × | ○ | ○ |
| 6 | | × | × | × | ○ | × | ○ | × | × |
| 5 | | ○ | ○ | ○ | × | ○ | ○ | ○ | ○ |
| 4 | | × | ○ | × | ○ | × | ○ | × | ○ |
| 3 | | ○ | × | ○ | ○ | × | ○ | ○ | × |
| 2 | | × | ○ | × | ○ | × | ○ | × | ○ |
| 1 | | | | | | | | | |
| | 1 | 2 | 3 | 4 | 5 | 6 | 7 | 8 | 9 |

NUMBER OF BEAMS (n)

VALUE OF α FOR da/D IN GAUSSIAN DISTRIBUTION BEAM

MULTI-BEAM SCAN OPTICAL SYSTEM

This is a continuation-in-part of U.S. patent application Ser. No. 07/842,712, filed on Feb. 27, 1992 for "MULTI-BEAM SEMICONDUCTOR LASER ARRAY AND MULTIBEAM LASER PRINTER", the disclosure of which is incorporated herein by reference.

BACKGROUND OF THE INVENTION

1. Field of the Invention

The present invention relates to a laser beam scan optical system for writing image information with optical beams in digital copying machines, laser beam printers, optical disks, and the like. More particularly, the invention relates to a multi-beam scan optical system for writing image information with a plurality of laser beams.

2. Discussion of the Related Art

FIGS. 3A and 3B are explanatorydiagrams for an example of a conventional laser scan apparatus, which is used for the writing unit of a digital copying machine. Particularly, FIG. 3A is a plan view showing an optical system for a multi-beam scan, which simultaneously writes two lines on a photoreceptor with two laser beams. FIG. 3B is a side view showing the multi-beam scan optical system of FIG. 3A. The optical system includes a multi-beam laser diode array 01 as a semiconductor laser light source for simultaneously emitting two laser beams (see FIGS. 3A, 3B, and 4).

As shown in FIG. 4, the multi-beam laser diode array 01 includes an electrode substrate 02 and an LD (laser diode) chip 03 located on the electrode substrate 02. The LD chip 03 includes a pair of laser diodes $LD_1$ and $LD_2$ on a chip substrate 04. In those diodes, oscillation regions 06 and 07 are separated from each other by an insulation layer 05. The space between the laser diodes $LD_1$ and $LD_2$ (distance between the oscillation regions 06 and 07) is $r_1$. Drive currents are fed from a drive circuit, not shown, through terminals Ta and Tb and electrodes 06*a* and 07*a* to the multi-beam laser diode array. Upon receipt of the drive currents, the laser diodes $LD_1$ and $LD_2$ emit first and second laser beams $L_1$ and $L_2$ forwardly, and back beams $L_1'$ and $L_2'$ backwardly. The diameters of the laser beams $L_1$ and $L_2$, at the time of their emission, are extremely small, 1 to 4 μm in the direction parallel to the hetero interface. Accordingly, the figures are too small to define the laser beam diameters. For this reason, the size of them as a light source is expressed in terms of a divergence angle $\theta_1$.

The multi-beam laser diode array 01 further includes a photo diode 08. The photo diode 08 receives the back beams $L_1'$ and $L_2'$ and outputs a light-quantity signal to a terminal Tc that is connected to a light-quantity controller, not shown.

As shown in FIGS. 3A and 3B, an optical system M for a multi-beam scan is located in the optical path for the laser beams $L_1$ and $L_2$ that are emitted from the oscillation regions 06 and 07. The optical system includes a collimate lens 010 of the focal distance $f_1$, a cylindrical lens 012 of the focal distance $f_2$, which has an optical power only in the subsidiary scan direction, a mirror 013, a rotating polygon mirror 014, an f-θ lens 015, and a cylindrical lens 016. The optical system M scans the surface (i.e., the photoreceptor surface) of a photoreceptor 018 in the form of a drum, which is rotated about the center shaft.

A first scan optical system $M_l$ consisting of the collimate lens 010 and the cylindrical lens 012 has the lateral magnification of $m_1$ in the subsidiary scan direction. A second scan optical system $M_2$ consisting of the f-θ lens 015 and the cylindrical lens 016 has the lateral magnification of $m_2$ in the subsidiary scan direction. A photo sensor 019 is located near one of the ends of the photoreceptor 018. The output timing of an image signal applied to the laser diodes $LD_1$ and $LD_2$ is determined by a beam position detecting signal SOS (start of scan, see FIG. 3A) that is output from the photo sensor 019.

FIGS. 5 and 6 are explanatory diagrams for showing the spots of the laser beams $L_1$ and $L_2$ on the photoreceptor surface 018*a* when image information is written on the photoreceptor surface by using the optical system M. Here, a natural number $r_i$, which represents the result of dividing the distance $r_3$ of the scan lines along which the two adjacent laser beams $L_1$ and $L_2$ scan by the scan line width. (scan pitch) p, is defied as "interlaced scanning period".

The illustration of FIG. 5 shows a case where the number n of laser beams is 2, and the interlaced scanning period i is 1. The diameters of the beam spots a and h (as viewed in the subsidiary scan direction) of the laser beams $L_1$ and $L_2$ on the photoreceptor surface 018*a* are equal, $d_3$. In the present specification, the diameter of the beam spot is defined as an areal part within which the maximum intensity of light, $(1/e)^2=0.135$, extends. $a_1$ and $b_1$ indicate respectively the positions of the spots a and b in the first scan (indicated as the scan number (1) in the figures); $a_2$ and $b_2$, the positions of the spots in the second scan; $a_t$ and $b_t$, the positions of the spots in the t-th scan (t=1, 2, 3, . . . ).

In FIG. 5, first and second scan lines are simultaneously traced with the first and second laser beams $L_1$ and $L_2$ in the first scan, or the scan of scan No. (1). Then, third and fourth scan lines are simultaneously traced with the first and second laser beams $L_1$ and $L_2$ in the scan of scan No. (2). Subsequently, the scans of scan Nos. (3), (4), (5), . . . are repetitively performed every two scan lines.

The illustration of FIG. 6 shows a case where the interlaced scanning period i is 5, that is, the distance $r_3$ between the two laser beams $L_1$ and $L_2$ is 5p (p: scan line pitch). In this case, the second scan line and the fourth scan line are traced with the second laser beam $L_2$ in the scans of scan Nos. (1) and (2). In the scan of scan No. (3) and the subsequent ones, the sixth, eighth, tenth, . . . scan lines are traced with the second laser beam $L_2$. At the same time, the first, third, fifth scan lines, . . . , that are located preceding by five lines to those traced by the second laser beam $L_2$, are simultaneously traced with the first laser beam $L_1$.

In FIGS. 5 and 6, the outline of the conventional multi-beam scan apparatus was described by using the example where the two laser beams were used for the scanning operation. The multi-beam interlaced scanning operation as described above is allowed if the number n of laser beams and the interlaced scanning period i are mutually prime, viz., the number of the laser beams and the interlaced scanning period do not have any positive integers exactly divisible in common other than 1. In this respect, the multi-beam scan apparatus using three or more laser beams has been already known.

The conditions to realize the interlaced scanning will be described by using an example where four laser beams are used for the scan beams as shown in FIG. 8.

In the example, as shown in FIG. 8, an n (n=4) number of spots $s_j$ (j=1 to n) are arrayed at intervals i (i=3) times as large as the scan line interval p (viz., at interlaced scanning periods i). With the four beam spots thus arrayed, the scan is performed at subsidiary scan intervals q (q=4) times as large as the scan interval p. When the number t of scans reaches $t_0$, $t=t_0$ ($t_0=3$), one cycle is completed. In other words, the number $t_0$ of one cycle is 3.

In FIG. 8, the scan number (No.) is denoted as t. The first scan is indicated by t=1; the second scan, by t=2; the third scan, by t=3; the fourth scan, by t= 4; and so on. At the scan No. (number of scans), t=3, the scan of the first cycle is completed. The scans of t=4 to t=6 make up the scan of the second cycle. The scan lines of the first scan cycle are denoted as $L_{1,0}$ to $L_{1,11}$, and the scan lines of the second scan cycle are denoted as $L_{2,0}$ to $L_{2,11}$.

The spots $s_j$ (j=1 to 4) must be located on the scan lines, respectively. Hence, i and g are natural numbers.

To realize the interlaced scanning period, the following two conditions (a) and (b) must hold;

(a) All the scan lines are traced by scan.

(b) The same scan line is not traced two times.

As shown in FIG. 8, in the scan of t=1 (first scan), four lines $L_{1,0}$, $L_{1,3}$, $L_{1,6}$, and $L_{1,9}$ are traced. The scans of t=1 to t=3 complete the first scan cycle. Accordingly, at t=4, the first scan in the next scan cycle starts. At this time, to satisfy the above two conditions (a) and (b), a spot S1 at t=4 must be at the position of a spot S5 as indicated by a dotted line in FIG. 8. In other words, when $t_0$=3, viz., the number of scans for one cycle is reached, the distance $t_0 \times qp$ by which the spot has been moved must be equal to the length $n \times ip$ of the series of spots in one cycle. That is, $$t_0 q = ni \quad \text{(a)}$$

Each spot interval i is filled with the $t_0$ ($t_0$=3) number of scans. Therefore, $ip = t_0 p$, and hence $$i = t_0 \quad \text{(b)}$$

Substituting the equation (b) into the equation (a), we have $$q = n \quad \text{(c)}$$

As seen from FIG. 8, the position (line) of the spot $S_1$ at the first scan of the second cycle, viz., at t= 4, advances by ni line from the position (line) of the spot $S_1$ at t=1. The quantity of the movement of a given spot $S_j$ for one cycle is the common multiple in of the interlaced scanning period i and the number n of spots.

Meanwhile, the condition (b) is that the same scan line is not repeatedly traced with each spot during one cycle. To satisfy the condition, the number n of spots and the interlaced scanning period i must be mutually prime. This will be described with reference to FIG. 9.

In FIG. 9, the scan line number L(t, k) can be described by using n of spots and the interlaced scanning period i and mathematically be expressed by $$L_{(t,\,k)} = (n \cdot t + 1) + i(k - 1) \quad \text{(d)}$$

where t=−i+1, . . . −1, 0, 1, . . . , i−1 (integer representative of the scan number)

k=1, 2, . . . , n (natural number representative of spot number)

In FIG. 9 and the equation (d), the number of the scan line scanned by a spot $S_k$ (k=1, 2, . . . ) for the scan number t is expressed by L(t, k). Accordingly, when t=0 and k=1, L(t, k)=1.

To avoid the repetitive scan of the same scan line by the spot, it is required that the scan line numbers of the scan lines scanned with two spots arbitrarily selected are not coincident with each other within the spot length ni. The requirement can be achieved when the following relations hold $$L(t_1, k_1) = (n \cdot t_1 + 1) + i(k_1 - 1) \neq (n \cdot t_2 + 1) + i(k_2 - 1) = L(t_2, K_2) \quad \text{(e)}$$

$$\therefore\ n \cdot (t_1 - t_2) \neq i(-k_1 + k_2)$$

where $(t_1 - t_2)$ and $(-k_1 + k_2)$ are arbitrary integers, and particularly $$-n+1 \leqq (-k_1+k_2) \leqq n-1 \quad -k_1+k_2 \neq 0 \quad \text{(f)}$$

In the above relations, $t_1$ and $t_2$ are two different scan numbers arbitrarily selected, $k_1$ and $k_2$ are different spot numbers also arbitrarily selected.

When $(t_1 - t_2)$ and $(-k_1 + k_2)$ have the same signs and are positive integers, if i and n are mutually prime, the least common multiple is i·n. From the equation (f), the right side $(-k_1 + k_2)$ of the inequality (e) is less than i·n, i.e. $(-k_1 + k_2) < i \cdot n$. Therefore, the product of multiplying n by the arbitrary integer $(t_1 - t_2)$ is not equal to $i(-k_1 + k_2)$, which is an integer smaller than the least common multiple i·n of the numbers i and n. Hence, the inequality (e) holds.

Also for the integers of negative signs, the above inequality holds. When their signs are different, i·n is a positive integer. Therefore, the inequality (e) holds also in this case.

As seen from the foregoing discussion, the interlaced scanning is valid if the following two conditions are satisfied:

(1) The quantity of movement of the spot in the subsidiary scan direction for one main scan is n·p (n: the number of laser beams, and p: scan line interval).

(2) i and n are natural numbers that are relatively prime (the greatest common divisor is 1). The interlaced scanning periods i and the number n of laser beams are tabulated in FIG. 10. As seen from the table of FIG. 10, the number n of laser beams is determined, the possible interlaced scanning periods i can be discretely obtained.

The factors to determine the picture quality of the reproduced picture are the spot diameter of the laser beam projected onto the photoreceptor surface, the width (i.e., scan pitch) of one scan line on the photoreceptor surface, laser power, and the like.

During a tone display by mesh-dots through the background exposure, when the diameter of the spot in the subsidiary scan direction is excessively large, the colored part in the highlight portion is too small to be reproduced into an image. In the shadow portion, the bleached part loses its contour. On the other hand, when the spot diameter is excessively small in the subsidiary scan direction, the colored part in the highlight portion is too large. Thus, the picture quality of the reproduced picture depends on the spot diameter of the laser beam on the photoreceptor surface.

In a case where in FIGS. 5 and 6, the diameter of the spot of the laser beam applied to the photoreceptor surface is $d_3$ and the width (i.e., scan pitch) of one scan line on the photoreceptor surface is n, selection of the value $K = (d_3/p)$ to be within the range between 1.4 to 1.8 will provide an excellent tone reproduction performance. This fact has been known. Reference is made to the paper by Tanaka in "Optics Four Academies, The 6th Color Optics Conference Paper Collection, p77, 1989".

Where the laser beam has a larger power, the value K is 1, viz., the spot diameter $d_3$ of laser beam projected onto the photoreceptor surface is equal to the width (scan pitch) p of one scan line on the photoreceptor surface. Even in a state that the photoreceptor surface is scanned, with a plurality of scan beams, closely but without any overlapping of the beams thereon, an excellent image reproduction can be obtained. To realize a satisfactory image reproduction, K should be selected to be between 1.0 and 1.8, more preferably 1.4 and 1.8.

In the laser beam scan optical system using the multibeam, the laser beams $L_1$ and $L_2$ pass through one and the same scan optical system. As to the distance $r_3$ between the spots a and b of the laser beams $L_1$ and $L_2$ on the photoreceptor surface 018*a* and the diameter $d_3$ of each of the spots a and b as viewed in the subsidiary scan direction, it is easy to set the distance $r_3$ between the spots a and b of the laser beams $L_1$ and $L_2$ to be integer times as large as the scan pitch p, and to set the value $K=(d_3/p)$ to be within 1.0 and 1.8, provided that the distance (as viewed in the subsidiary scan direction) between the laser diodes $LD_1$ and $LD_2$ of the laser diode array 1 as a light source and the diameter (as viewed in the subsidiary scan direction) of the oscillation region of each laser diode (spot diameter of the laser beam when it is emitted) are exactly obtained.

It is difficult to exactly obtain the beam spot diameter since the diameter is too small. The diameter $d_3$ of each beam spot can accurately be obtained by using the divergence angle $\theta_1$ of the laser beams $L_1$ and $L_2$ that are respectively emitted from the laser diodes $LD_1$ and $LD_2$. When the laser beam passes through the scan optical system, the peripheral part of the beam is removed by components making up the optical system, such as the lens, and the rotating polygon mirror. This peripheral removal of the laser beam is frequently called a "truncation". Because of this phenomenon, it is difficult to set the distance $r_3$ between the spots a and b of the laser beams $L_1$ and $L_2$ to be interlaced scanning period times as large as the scan pitch p, and to set the value $K=(d_3/p)$ to be within 1.0 and 1.8. For this reason, in the multi-beam scan optical system, it is difficult to obtain satisfactory tone reproduction performance and a good reproduction of the line image.

SUMMARY OF THE INVENTION

The present invention has been made in view of the above circumstances and has an object to provide a multi-beam scan optical system which is improved in the tone reproduction performance of a half-tone image and the reproduction performance of a linear image.

In order to attain the above object, the present invention provides a multi-beam scan optical system including: a laser array including a plurality of laser diodes driven by LD drive signals independently modulated, oscillation positions of the laser diodes being separated from each other by a distance $r_1$; a first scan optical system including a collimate lens for collimating a plurality of laser beams emitted from the plurality of laser diodes, each of the laser beams having a $(1/e^2)$ intensity divergence angle $\theta_1$ in a subsidiary scan direction and a wave length $\lambda$, a first subsidiary-scan directional power optical member having an optical power in the subsidiary scan direction for focusing the collimated laser beams on facets of a rotating polygon mirror, and an aperture located at a position where the. plurality of collimated laser beams cross an optical axis of the first scan optical system; and a second scan optical system including an f-$\theta$ lens disposed between the rotating polygon mirror and a photoreceptor surface, and a second subsidiary-scan directional power optical member having an optical power in the subsidiary scan direction for focusing the laser beams emanated from the f-$\theta$ lens on the photoreceptor surface in a state that the laser beams are separated from each other by a given interlaced scanning period i in the subsidiary scan direction, wherein the parameters $r_1$, $\lambda$, $\theta 1$, and i are selected so as to satisfy the following relation $$K=\frac{4}{\pi}\ \alpha\ \frac{i\lambda}{r_1\theta_1}$$

where $1.0 \leqq K \leqq 1.8$, and $\alpha$ depends on a diameter of the aperture as viewed in the subsidiary scan direction and satisfies the following relation $$d_2=(4\alpha/\pi)(\lambda f_2/D)$$

where $f_2$ indicates a focal distance of the first subsidiary-scan directional power optical member, D indicates a $(1/e^2)$ intensity diameter of each of the collimated laser beams to enter the aperture, and $d_2$ indicates a spot diameter in the subsidiary scan direction of each of the laser beams which are focused on the facets of the rotating polygon mirror.

BRIEF DESCRIPTION OF THE DRAWINGS

The accompanying drawings, which are incorporated in and constitute a part of this specification illustrate embodiment of the invention and, together with the description, serve to explain the objects, advantages and principles of the invention. In the drawings.

FIG. 10 is a table showing the combinations of the number n of laser beams and the interlace period i which satisfy the interlaced scanning conditions;

DETAILED DESCRIPTION OF THE PREFERRED EMBODIMENT

Preceding with the detailed description of the preferred embodiment of the invention, the basic idea of the present invention will theoretically be described.

To solve the problems, the present inventor considered the following. The spot-to-spot distance $r_3$ and the spot diameter $d_3$ must be determined by using the values of parameters, such as the distance $r_1$ between the multi-beam-emitting laser diodes of the semiconductor laser array, the divergence angle $\theta_1$ of the laser beams, and the wave length $\lambda$ of the laser beams, and the focal lengths of the components forming the optical system. If the relation among those parameters are obtained, it is easy to set the distance $r_3$ between the spots a and b of the laser beams $L_1$ and $L_2$ to be interlaced scanning period times as large as the scan pitch p, and to set the value $K=(d_3/p)$ to be between 1.0 and 1.8 by selecting the parameters so as to satisfy the relation. As a result, the tone reproduction performance of the multi-beam scan optical system can be readily improved.

Figure 3A:
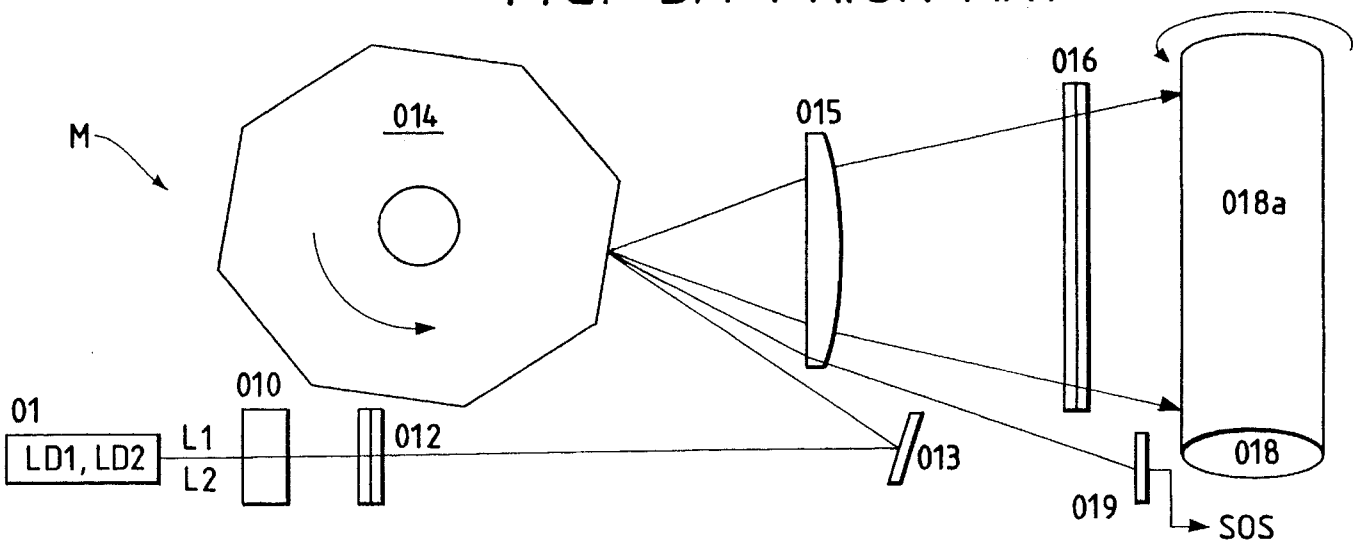
FIG. 3A PRIOR ART
FIG. 3A is a plan view showing of a conventional multi-beam scan optical system.
Figure 3B:
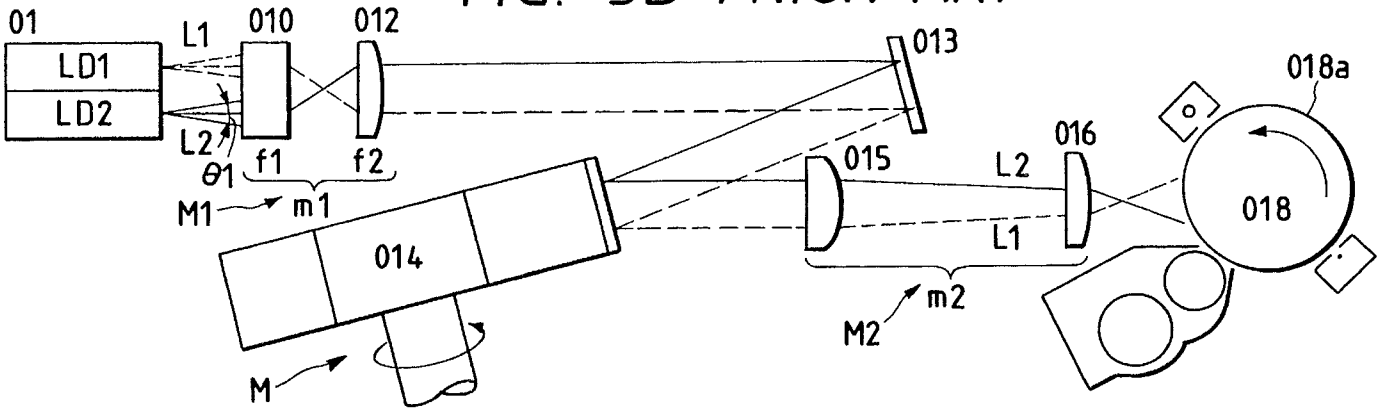
FIG. 3B PRIOR ART
FIG. 3B is a side view showing the multi-beam scan optical system of FIG. 3A.
Figure 4:
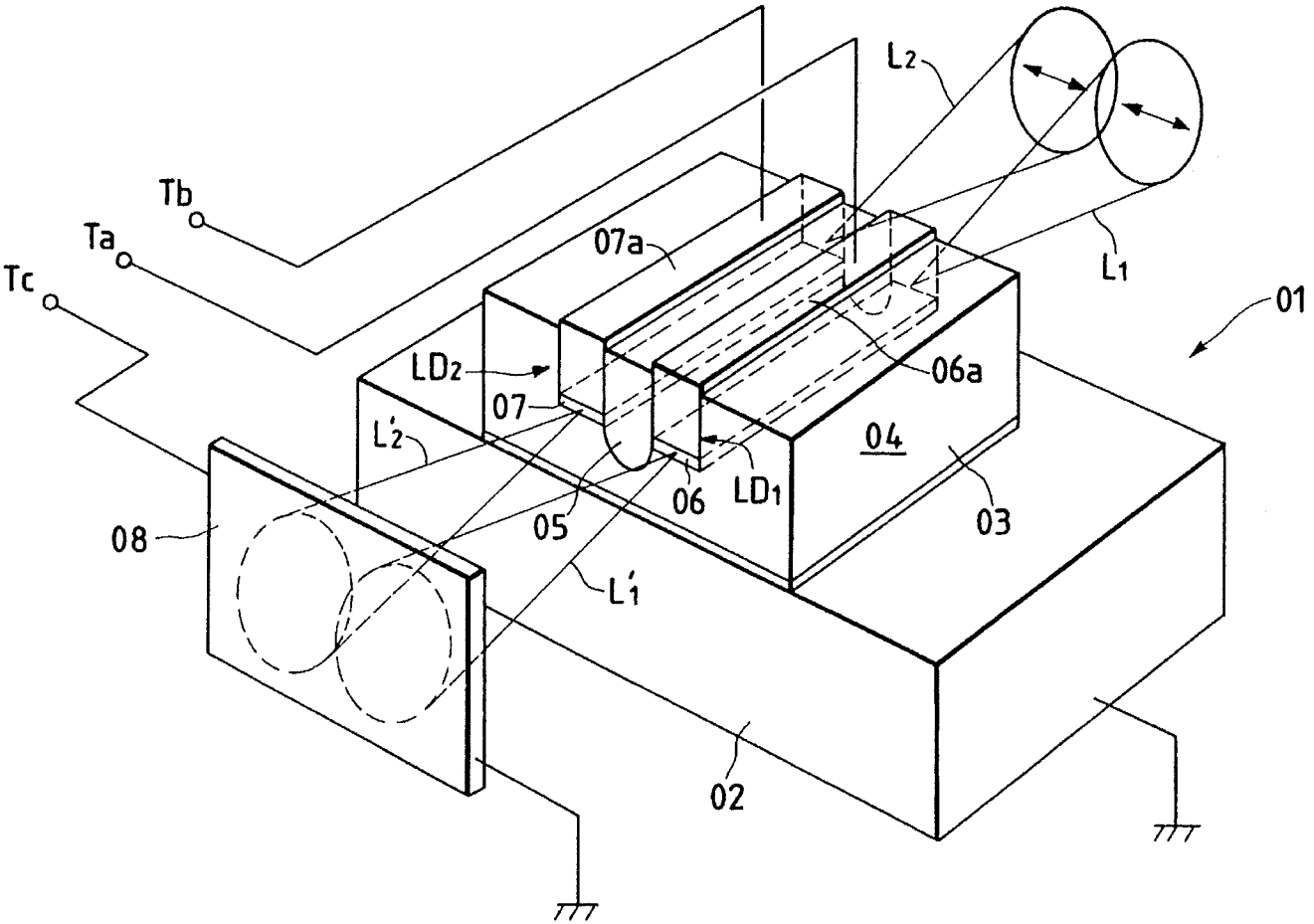
FIG. 4 PRIOR ART
FIG. 4 is a perspective view showing the construction of a laser array light source in the conventional multi-beam scan optical system.
Figure 5:
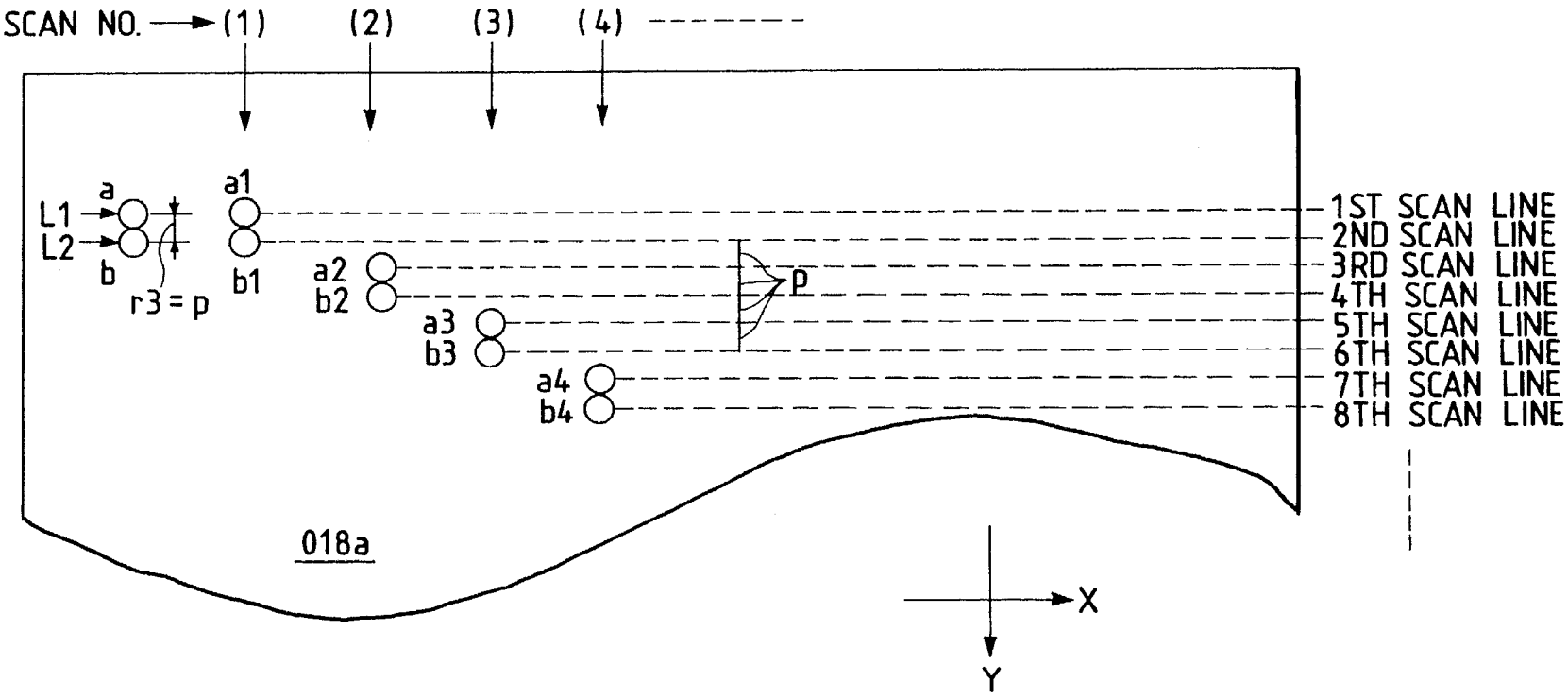
FIG. 5 PRIOR ART
FIG. 5 is an explanatory view depicting the relationship between the laser beam spot diameter and the scan pitch on the surface of a photoreceptor in the conventional multi-beam scan optical system.
Figure 6:
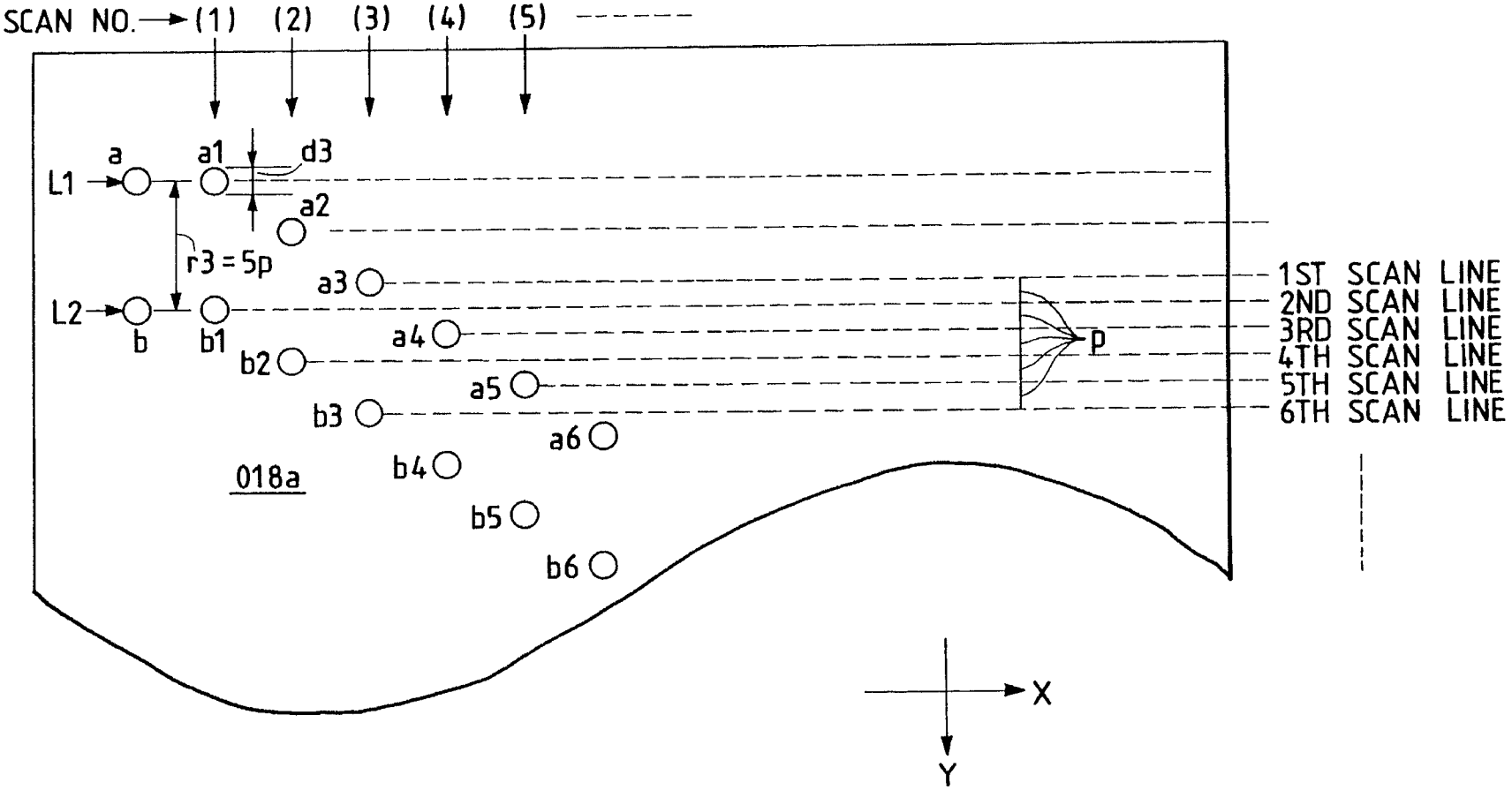
FIG. 6 PRIOR ART
FIG. 6 is an explanatory view depicting the relationship between the laser beam spot diameter and the scan pitch on the surface of a photoreceptor in another conventional multi-beam scan optical system.

As the result of the study based on the above, the inventor has succeeded in finding the fact that the following relation (*1*) holds in a multi-beam scan optical system in which an aperture is located at a position where plural laser beams ($L_1$ and $L_2$) collimated cross the optical path of the scan optical system in the laser scan apparatus as shown in FIGS. 3A and 3B.

$$K=\frac{4}{\pi}\ \alpha\ \frac{i\lambda}{r_1\theta_1} \tag{1}$$

where $\pi$: circular constant $r_1$: distance between the laser diodes $LD_1$ and $LD_2$ $\theta_1$: divergence angle (as viewed in the subsidiary scan direction) of the laser beams $L_1$ and $L_2$ emitted from the laser diodes $LD_1$ and $LD_2$ $\lambda$: wave length of each of the laser beams $L_1$ and $L_2$ i: natural number representing the result of dividing the distance $r_3$ between the spots a and b (see FIGS. 5 and 6) of the laser beams $L_1$ and $L_2$ on the photoreceptor surface 018*a* by the scan pitch p $\alpha$: value depending on the aperture diameter as viewed in the subsidiary scan direction, the value satisfying the following relation $d^2=(4\alpha/\pi)(\theta f_2/D)$ where $f_2$ indicates the focal distance of the cylindrical lens 012, D indicates the subsidiary-scan directional spot diameter of each of the laser beams $L_1$ and $L_2$ that are collimated, and $d_2$ indicates the subsidiary-scan directional spot diameter of each of the laser beams $L_1$ and $L_2$ which are focused on the facets of the rotating polygon mirror 014

K: result of dividing the subsidiary-scan directional spot diameter $d_3$ of each of the spots a and b of the laser beams $L_1$ and $L_2$ on the photoreceptor surface 018*a* by the scan line width (scan pitch) p, that is, $K=d_3/p$.

Next, the reason why the relation (1) holds will be described.

Figure 7A:
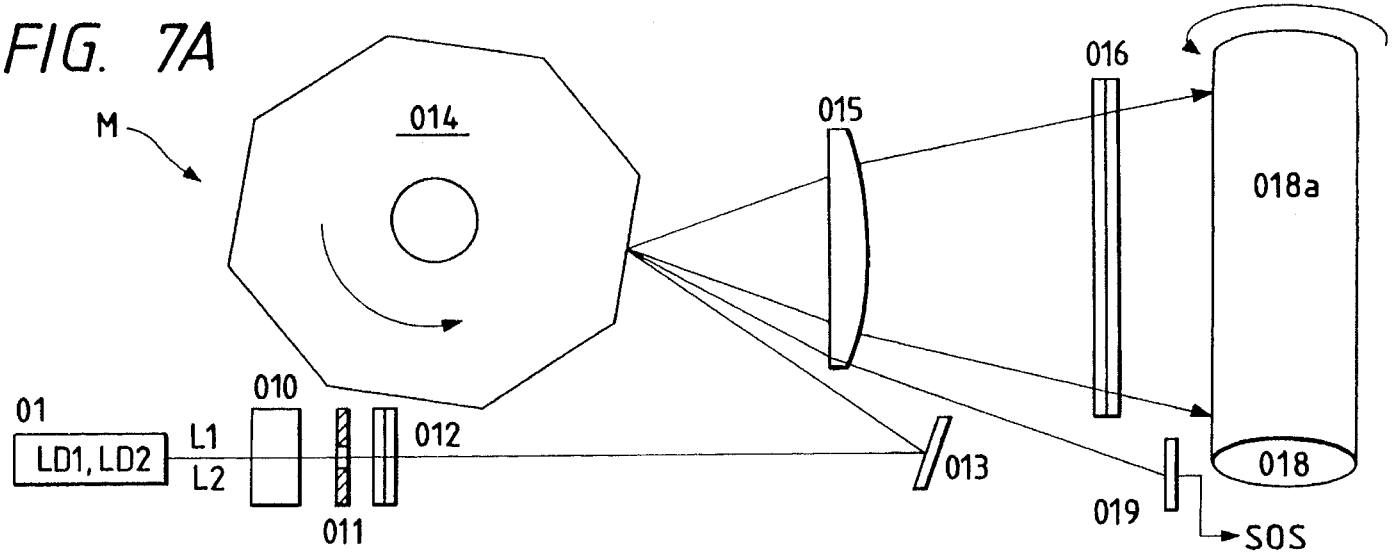
FIG. 7A is a plan view showing another multi-beam scan optical system, which is equivalent to the multi-beam scan optical system of FIG. 3A additionally having an aperture.
Figure 7B:
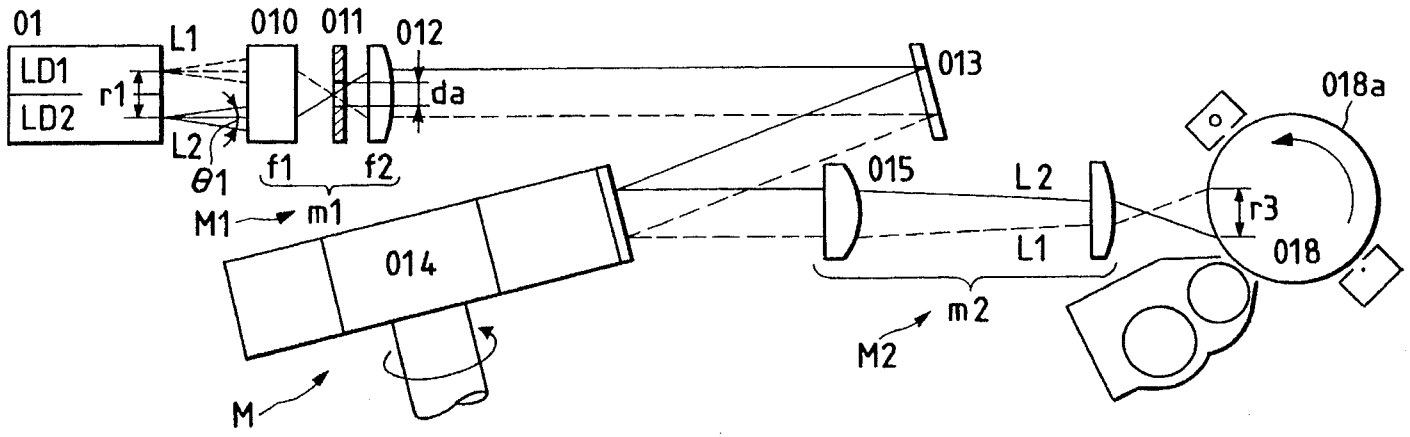
FIG. 7B is a side view showing the multi-beam scan optical system of FIG. 7A.

FIGS. 7A and 7B are explanatory diagrams showing a scan optical system equivalent to the multi-beam scan optical system M of FIGS. 3A and 3B which further contains an aperture 011. The aperture 011 is disposed at a position where the laser beams $L_1$ and $L_2$ after passing through the collimate lens 010 intersect the optical axis.

In FIGS. 7A and 7B, the following relation (2) holds $$r_3=mr_1=m_1m_2r_1 \tag{2}$$

where m: lateral magnification of the multi-beam scan optical system M composed of the optical components designated by reference numerals 010 to 016.

The spot-to-spot distance $r_3$ may be also expressed by the following relation (3)

$$r_3=ip=mr_1 \tag{3}$$

where i is the interlaced scanning period.

The spot diameter D of the laser beam emitted from the collimate lens 010 is expressed by $$D=f_1\times 2\sin(\theta_1 2)=f_1\theta_1 \tag{4}$$

where $f_1$ is the focal distance of the collimate lens 010.

After the laser beams $L_1$ and $L_2$ cross the optical axis at the position of the aperture, they are focused on the facet of the rotating polygon mirror 014 by the cylindrical lens 012 of the focal length $f_2$. Accordingly, from the diffraction integral by Fresnel and Kirchhoff, we can use the following relation (5) describing the diameter $d_2$ (as viewed in the subsidiary scan direction) of each of the spots of the laser beams $L_1$ and $L_2$ on the facet of the rotating polygon mirror 014

$$d_2=(4\alpha/\pi)(\lambda f_2/D) \tag{5}$$

Figure 11:
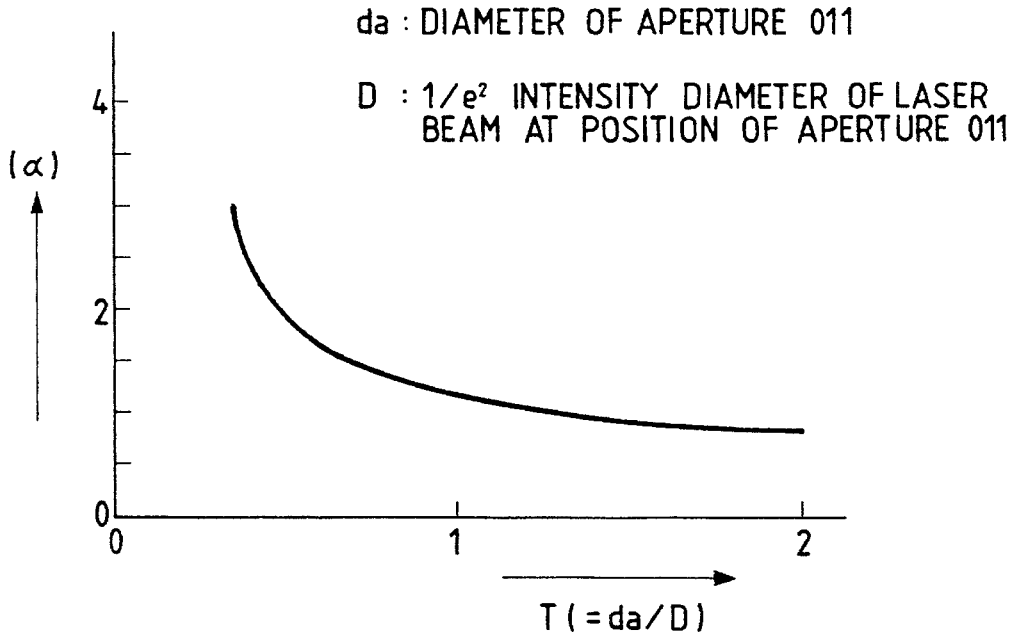
FIG. 11 is a graph showing the relationship between $\alpha$ vs. $1/e^2$ intensity diameter D of a laser beam at the position where an aperture of the diameter da is located.

The value of $\alpha$ in the relation (5) is a constant, which is determined by the diameter of the aperture 011 as viewed in the subsidiary scan direction. If the diameter da of the aperture 011 is equal to the diameter of a part having an intensity ½ as high as the highest intensity part (beam central part) of the collimated laser beam of the outside diameter D (hereinafter, this diameter will be referred to "½ intensity diameter)". In the case of the beam of which the intensity is distributed according to the Gaussian distribution, the ½ intensity diameter is: D/1.70=0.59D, the value of $\alpha$, as shown in FIG. 11, is $\alpha=1.94$.

In a case where the inside diameter of the aperture 011 is a $1/e^2$ intensity diameter (i.e., it is the diameter equal to the diameter of a part of which the intensity is $1/e^2=(0.135)$ times as high as the intensity of the highest intensity part of the laser beam), the value of $\alpha$ is $\alpha=1.28$.

In another case where the inside diameter of the aperture 011 is considerably larger than the diameter D of the collimated laser beam or the aperture 011 is not used, the value of $\alpha$ is $\alpha=1$.

The lateral magnification $m_1$ of the first scan optical system $M_1$, which is composed of the collimate lens 010 of the focal distance $f_1$ and the cylindrical lens 012 of the focal distance $f_2$, is $$m_1=f_2/f_1 \tag{6}$$

Substituting the relations (4) and (6) into the relation (5), we have the following relation (7)

$$d_2=(4\alpha/\pi)(\lambda f_2/D)=(4\alpha/\pi)(\lambda f_2/f_1\theta_1)=(4\alpha/\pi)(\lambda m_1/\theta_1) \tag{7}$$

If the stop in the second scan optical system $M_2$ located between the rotating polygon mirror 014 and the photoreceptor surface 018*a* is, much larger than the spot diameter of the laser beam, the following relation (8) holds $$d_3=m_2d_2 \tag{8}$$

Substituting the relation (7) into the relation (8), we have $$d_3=(4\alpha/\pi)\lambda m_1m_2/\theta_1=(4\alpha/\pi)\lambda m/\theta_1 \tag{9}$$

Since $K=d_3/p$, the relation (9) can be rewritten into $$Kp=(4\alpha/\pi)\lambda m/\theta_1 \quad (10)$$

Also substituting the relation (3) into the relation (10), then we have $$K/i=(4\alpha/\pi)\lambda/r_1\theta_1 \quad (11)$$

Rearranging the relation (11) for K, the relation (1) can be obtained.

In the relation (1), if the value of K is set to be any of the values within the range between 1.0 to 1.8, the remaining parameter values can readily be determined.

The preferred embodiment of the present invention that is constructed on the basis of the basic technical idea as mentioned above, will be described with reference to the accompanying drawings.

Figure 1A:
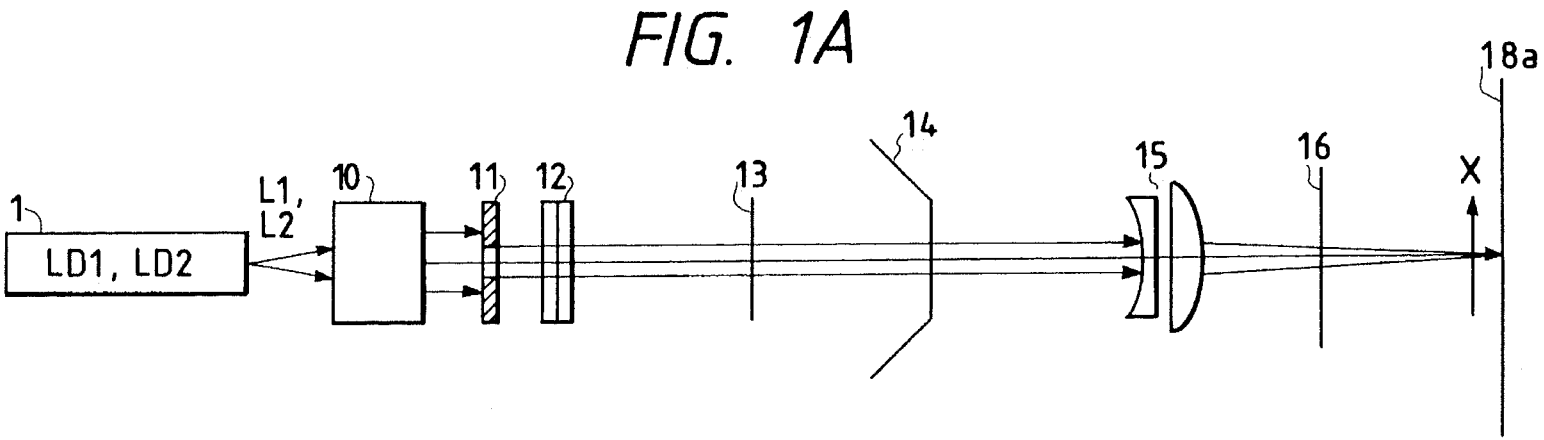
FIG. 1A is a plan view showing a multi-beam scan optical system according to an embodiment of the present invention.
Figure 1B:
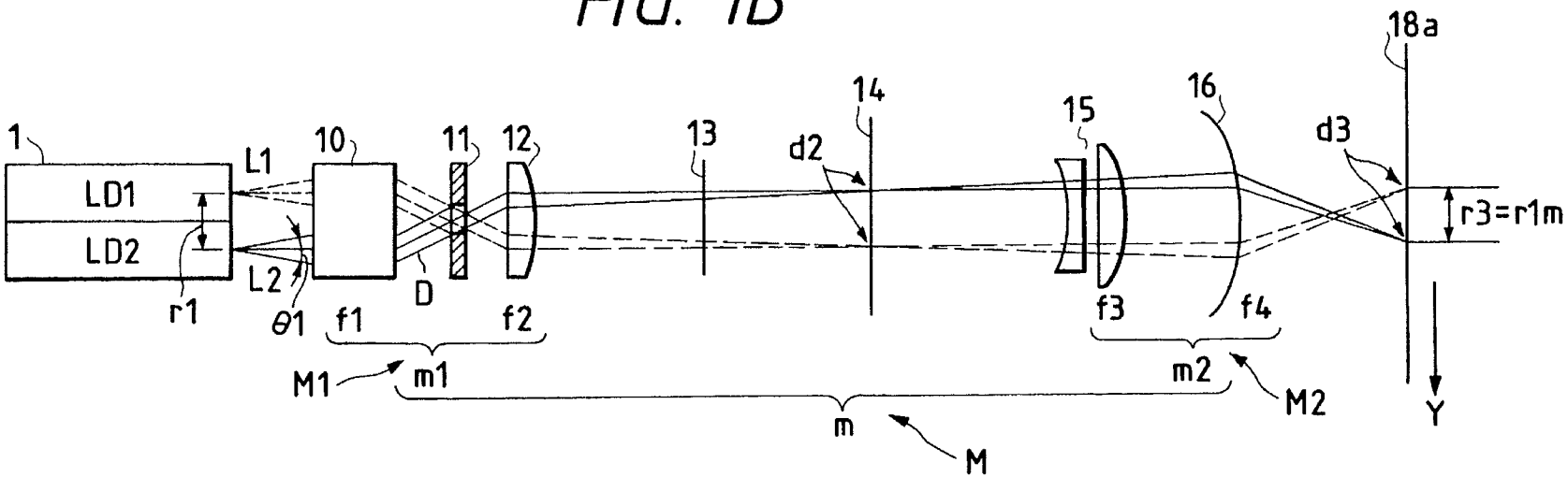
FIG. 1B is a side view showing the multi-beam scan optical system of FIG. 1A.

FIG. 1A is a plan view showing a multi-beam scan optical system according to the embodiment of the present invention. Fig. 1B is a side view showing the multi-beam scan optical system of FIG. 1A.

In FIGS. 1A and 1B, the components corresponding to those in FIGS. 7A and 7B are designated by the reference numerals in FIGS. 7A and 7B from which the most significant digits, 0s, are removed. A component 16 in FIGS. 1A and 1B as a subsidiary-scan directional power optical member is a cylindrical mirror in place of the cylindrical lens 016 in FIGS. 7A and 7B. The remaining components of the present embodiment are the same as those in FIGS. 7A and 7B.

In FIGS. 1A and 1B, a first scan optical system $M_1$ is made up of components reference numerals 10 to 13. The lateral magnification of the first scan optical system $M_1$ is $m_1$.

In FIG. 1B, the focal distances of a collimate lens 10, a cylindrical lens (first subsidiary-scan directional optical member) 12, an f-θ lens 15, and the cylindrical mirror 16 are $f_1$, $f_2$, $f_3$, and $f_4$, respectively. The first scan optical system $M_1$, disposed between a laser array 1 and a rotating polygon mirror 14 is made up of the collimate lens 10, an aperture 11, cylindrical lens 12, and a mirror 13. The lateral magnification of the first scan optical system $M_1$ is $m_1$. A second scan optical system $M_2$, disposed between the rotating polygon mirror 14 and a photoreceptor surface 18*a*, is made up of the f-θ lens 15 and the cylindrical mirror 16, and has the lateral magnification $m_2$. A multi-beam scan optical system M, formed by combining the first and second scan optical systems $M_1$ and $M_2$ having the lateral magnifications $m_1$ and $m_2$, has the lateral magnification m.

$r_1$ represents the distance between the laser beam emitting positions of laser diodes $LD_1$ and $LD_2$. $\theta_1$ represents a divergence angle as viewed in the subsidiary scan direction of each of the laser beams $L_1$ and $L_2$ respectively emitted from the laser diodes $LD_1$ and $LD_2$. The laser beams $L_1$ and $L_2$ pass through the first scan optical system $M_1$ of the lateral magnification $m_1$ and are focused on the facets of the rotating polygon mirror 14. In this case, the spots of the laser beams on the facet have each the diameter $d_2$ as measured in the subsidiary scan direction. The laser beams $L_1$ and $L_2$, reflected by the rotating polygon mirror 14, pass through the second scan optical system $M_2$ and form spots a and b on the photoreceptor surface 18*a*. The diameter of each of those spots is $d_3$ as measured in the subsidiary scan direction Y. Those spots are separated by distance r3 from each other in the subsidiary scan direction.

In the present embodiment, the parameters of the multi-beam scan optical system M shown in FIGS. 1A and 1B are as follows:

$\lambda=0.78$ μm $r_1=10$ μm $\theta_1=13.5°=0.235$ radian $f_1=25$ mm $f_2=419.43$ mm $m_1=f_2/f_1=16.78$ $\alpha=1.28$ $m_2=0.5588$ $m=m_1\cdot m_2=9.377$ $p=31.25$ μm Let us calculate the subsidiary-scan directional diameter $d_3$ of each of the spots a and b on the photoreceptor surface 18*a*, and the distance $r_3$ between the spots a and b by using the parameters having the values selected as just mentioned.

$$r_3=r_1\cdot m=93.77\ \mu m$$

$$\therefore i=r_3/p=93.77/31.25=3$$

and $$D=f_1\cdot\theta_1=25\times0.235=5.9\ mm$$

$\therefore d_2=(4\alpha/\pi)\lambda f_2/D=90$ μm $\therefore d_3=d_2\cdot m_2=90\times0.5588=50$ μm $\therefore K=d_3/p=50$ μm/31.25 μm=1.6

Figure 2:
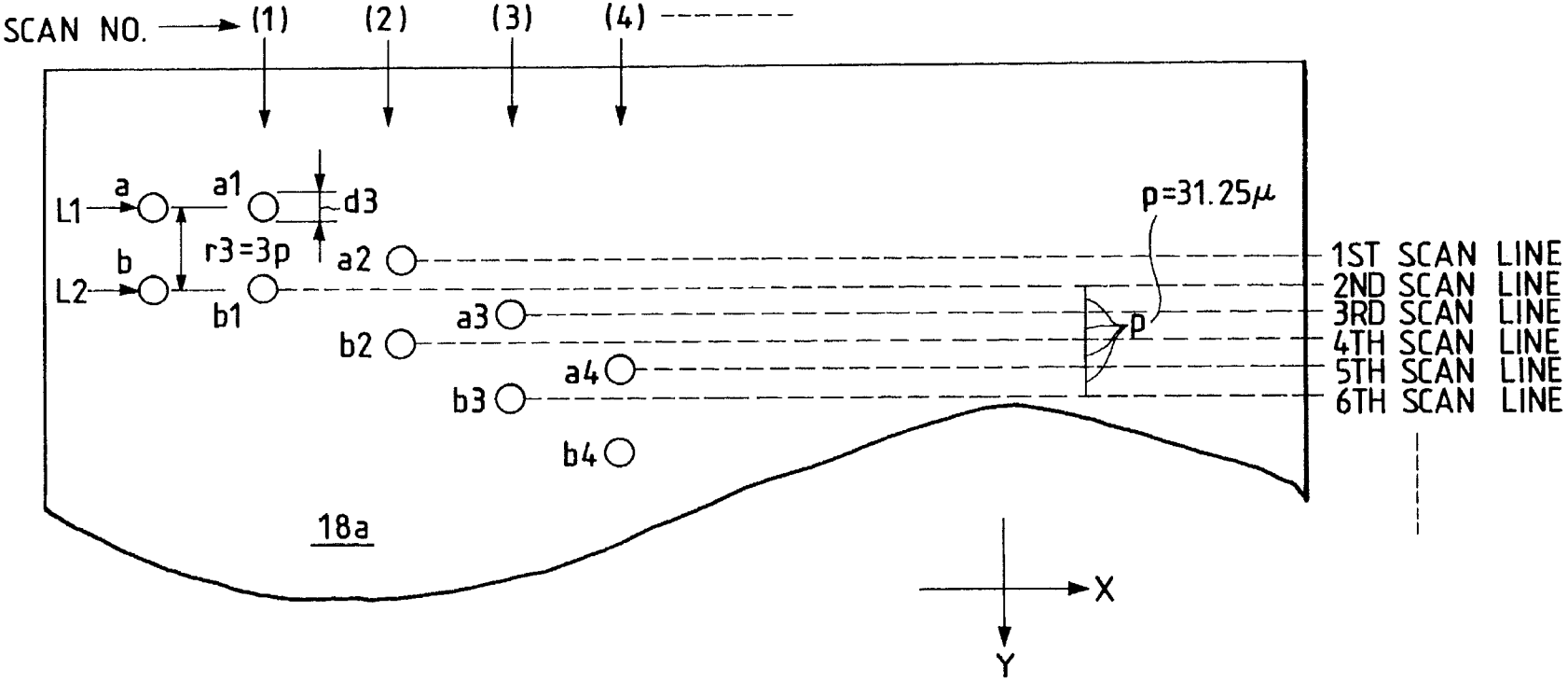
FIG. 2 is an explanatory view depicting the relationship between the laser beam spot diameter and the scan pitch on the surface of a photoreceptor.

The multi-beam scan optical system M shown in FIGS. 1A and 1B, of which the parameters have the values selected as mentioned above, forms the spots a and b of the laser beams $L_1$ and $L_2$ on the photoreceptor surface 18*a*, as shown in FIG. 2. In FIG. 2, the interlaced scanning period i is 3, i=3, and the distance $r_3$ between the spots a and b of the two laser beams $L_1$ and $L_2$ on the photoreceptor surface 18*a* is 3p, $r_3$=ip=3p.

In FIG. 2, at the scan number (1) the second laser beam L2 scans along the second scan line, and at the scan number (2) and the subsequent ones, it scans along the fourth, sixth, . . . scan lines, while at the same time the first laser beam $L_1$ scans along the first, third, fifth, . . . scan lines.

The scan optical system with the scan pitch p of 31.25 μm, is capable of printing an image on the photoreceptor surface 18*a* at the resolution of 1 mm/31.25 μm (=32 dots/mm).

In the multi-beam scan optical system M shown in FIGS. 1A and 1B, of which the parameters have the values selected as mentioned above, the value of K ($=d_3/p=1.6$) falls within the range between 1.4 and 1.8. Therefore, a good image reproduction can be obtained.

Description to follow is how to set parameters in the multi-beam scan optical system that was shown in FIGS. 1A and 1B and described referring to FIG. 2. In the optical system, the resolution is 32 dots/mm and K ($=d_3/p$) is within the range between 1.4 and 1.8.

The specific items of the laser array 1, which are used in the multi-beam scan optical system, are: The divergence angle $\theta_1$ (measured in the subsidiary scan direction, or the direction parallel to the hetero interface) of each of the laser beams $L_1$ and $L_2$ emitted from the laser diodes $LD_1$ and $LD_2$, is 13.5° ($\theta_1=13.5°$). The wave length $\lambda=0.78$ μm. The distance $r_1$ between the laser diodes $LD_l$ and $LD_2$ will be determined later.

For the resolution of 32 dots/mm, the scan pitch p is $$P=1000/32=31.25\ \mu m.$$

As already described, to obtain good image reproduction, $K=(d_3/p)$ must satisfy the following inequality $$1.4\leqq K(=d_3/p)\leqq1.8.$$

If $d_3/p=1.6$, then $d_3=50$ μm.

If the lateral magnification $m_2$ of the second scan optical system $M_2$, which is located between the rotating polygon mirror 14 and the photoreceptor surface 18*a*, is 0.5588 ($m_2$=0.5588), then the diameter $d_2$ (as measured in the subsidiary scan direction Y) of each of the spots of the laser beams $L_1$ and $L_2$, which are formed on the facets of the rotating polygon mirror 14 is 89 μm, ($d_2=d_3/m_2$=89 μm). When the parameters of the optical system components are determined as of the following items (a) to (e), we can realize the second scan optical system $M_2$ of which the lateral magnification $m_2$ is 0.5588.

(a) Focal distance $f_3$ of the f-θ lens 15=358.75 mm (b) Focal distance $f_4$ of the cylindrical mirror 16=109.88 mm (c) Distance from the facet of the rotating polygon mirror 14 to the principal point of the cylindrical mirror 16=133.01 mm (d) Distance from the principal point of the cylindrical mirror 16 to the photoreceptor surface 18*a*=147.79 mm (e) Distance between the f-θ lens 15 and the principal point of the cylindrical mirror 16=210.96 mm A value properly selected is used for the focal distance $f_2$ of the cylindrical lens 12. In this instance, $f_2$ =419.43 mm. The diameter of a part where the light intensity is $1/e^2$ times as high as the peak intensity of the collimated light beam incident on the cylindrical lens 12 is treated as the subsidiary-scan directional diameter D of the collimated light beam. An aperture used has the inside diameter equal to the diameter of the part where the light intensity is $1/e^2$ times as high as the peak intensity; that is, the aperture of which α is 1.28 is used. From diffraction integral by Fresnel and Kirchhoff, we can lead the following relation of $d_2$ $$d_2=(4\times1.28/\pi)\times(\lambda f_2/D).$$

The oscillation wavelength λ of each of the laser diodes $LD_1$ and $LD_2$ is

λ=0.78 μm

Then, D=5.9 mm. $D=f_1\cdot\theta_1$, and as described above, $\theta_1$=13.5° (=0.235 radian). Accordingly, $f_1$=25 mm.

Since the focal distances $f_1$ and $f_2$ are known, $$m_1=f_2/f_1=16.78.$$

Accordingly, the lateral magnification m of the multi-beam scan optical system M is $$m=m_1\cdot m_2=16.78\times0.5588=9.377.$$

In the case of FIG. 2, the interlaced scanning period i=3 and the scan pitch p=31.25 μm. Therefore, $$r_3=i\cdot p=93.75\ \mu m.$$

Accordingly, the distance $r_1$, between the laser diodes $LD_1$ and $LD_2$ of the laser array 1 is $$r_1=r_3/m=93.75/9.377=10\ \mu m$$

In this way, the parameters of the components composing the multi-beam scan optical system M are determined. A laser scan apparatus incorporating the multi-beam scan optical system M composed of the components having the thus determined parameters is improved in the image reproduction performance.

The method to determine the parameters of the components of the multi-beam scan optical system M may be summarized as follows. Let us consider a case where a scan optical system of the resolution of 32 dots/mm, which is excellent in the image reproduction performance, is constructed using a laser array of which $\theta_1$=13.5°. A value of the diameter $d_3$ is first determined, and a second scan optical system having a proper lateral magnification $m_2$ is then employed. Then, a cylindrical lens 12 (first subsidiary-scan directional power optical member) having a proper focal distance $f_2$ is properly selected. 1.28 is selected for the value of α that is determined by the diffraction integral by Fresnel and Kirchhoff. Then, the subsidiary-scan directional diameter D of the collimated light beam is determined through the relation (5). The focal distance $f_1$ can be determined by the diameter D of the collimated light beam and the divergence angle $\theta_1$. The lateral magnification $m_1$ is determined by the focal distances $f_1$ and $f_2$ already determined. The lateral magnifications $m_1$ and $m_2$ thus obtained determines the lateral magnification m of the multi-beam scan optical system M. The lateral magnification m determines the diode-to-diode distance $r_1$. In this way, the specifications of the laser array 1 are determined.

Selection of the value of α so as to satisfy 1.28≦α≦1.94 means that the inside diameter of the aperture 11 as viewed in the subsidiary scan direction is selected to be larger than the subsidiary-scan directional intensity diameter of the collimated light beam (i.e., D/1.70=0.59D) but is smaller than the $1/e^2$ intensity diameter (i.e., D). Such a selection of α can provide an excellent scan optical system for the reason as given below. Generally, the light quantity of the laser beam is distributed according to the Gaussian distribution. Accordingly, if the inside diameter of the aperture 11 becomes smaller than the ½ intensity diameter of the collimated light beam, the quantity of light (truncation quantity) cut by the aperture 11 remarkably increases. In other words, the light-quantity loss is large. This must be avoided.

Figure 12:
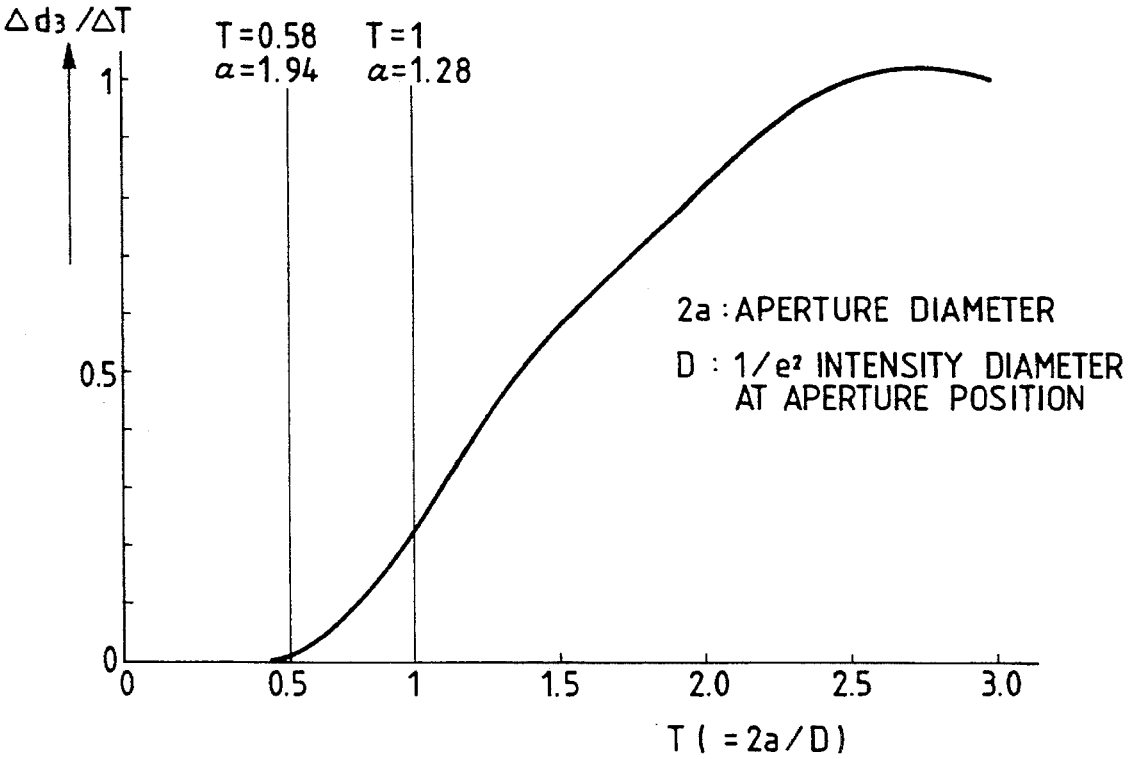
FIG. 12 is a graph showing a variation of the $1/e^2$ intensity diameter D of a laser beam at the position where an aperture of the diameter da is located with respect to the laser spot diameter.

The laser beams passing through the aperture 11 include the laser beams directly passing within the inside diameter of the aperture 11 and the laser beams passing therethrough by diffraction. The diameter of the laser beam spot on the photoreceptor surface 18*a* is determined by the superposition of the two types of laser beams, viz., by the diffraction integral by Fresnel and Kirchhoff. As the inside diameter of the aperture 11 is increased to be larger than ½, the influence by the diffraction becomes smaller. The spot diameter susceptibly varies with the variation of the laser beam diameter as shown in FIG. 12. As a result, it is difficult to adjust the spot diameter. If the diameter of the aperture is selected to be within the range of 0.58≦T≦1, or 1.28≦α≦1.94, the variation of the spot diameter on the photoreceptor surface 18*a*, which is due to the variation of the diameter of the beam entering the aperture, is minimized, thus providing an easy design of the scan optical system.

In the above-mentioned method for designing a multi-beam scan optical system with good image reproduction performance, which thus far described, the divergence angle $\theta_1$ of each of the laser beams $L_l$ and $L_2$ emitted from the laser diodes $LD_1$ and $LD_2$, and the wave length X are first fixed; $\theta_1$=13.5° and λ=0.78 μm. Thereafter, the diode-to-diode distance $r_1$, which is for obtaining a desired value of K (=$d_3$/p) is then fixed.

Description to follow is another design method in which the distance $r_1$ between the laser beams $L_1$ and $L_2$ emitted from the laser diodes $LD_1$ and $LD_2$ and the wave length λ are first fixed; $r_1$=10 μm and λ=0.78 μm, and then the divergence angle $\theta_1$ is determined.

As in the previous case, when the resolution is 32 dots/mm, the scan pitch p is $$p=1000/32=31.25\ \mu m.$$

As also recalled, to obtain good tone reproduction, for the K, the following inequality must hold $$1.4\leqq K(=d_3/p)\leqq1.8.$$

Thence, if $d_3/p=1.6$, $d_3=50$ μm.

$r_3=i\cdot p=93.75$ μm.

Accordingly, $m=r_3/r_1=93.75/10=9.375$

As in the previous manner, the lateral magnification $m_2$ of the second scan optical system $M_2$, which is located between the rotating polygon mirror 14 and the photoreceptor surface 18*a* is fixed at 0.5588, $m_2=0.5588$.

Then, the spot diameter $d_2$ is $d_2=d_3/m3=89$ μm. If a cylindrical lens 12 of which the focal distance $f_2$ is 419.43 mm is used, the $d_2$ is $$d_2=(1.6\lambda f_2)/D.$$

Since $d_2$, λ, and $f_2$ are known, we have

D=5.9 mm.

Since $m_1=m/m_2=f_2/f_1$ and m, $m_2$, and $f_2$ are known, $f_1$ can be calculated. Further, since $D=f_1\cdot\theta_1$, we can know $\theta_1$.

Figure 13:
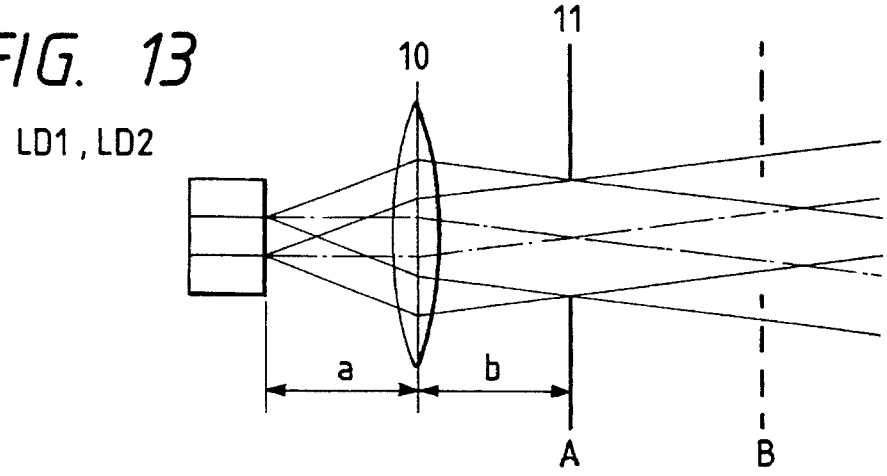
FIG. 13 is a view showing the position of an aperture in a multi-beam optical system when two laser beams are used.
Figure 14:
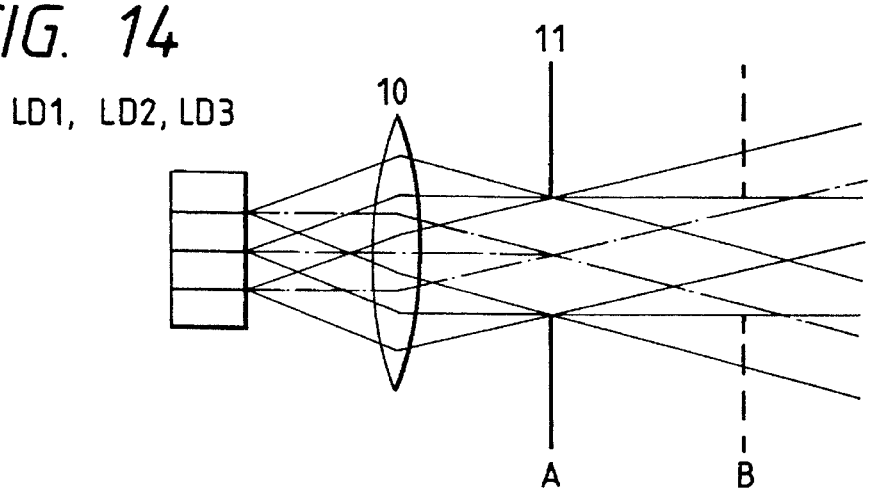
FIG. 14 is a view showing the position of an aperture in a multi-beam optical system when three laser beams are used.
Figure 15:
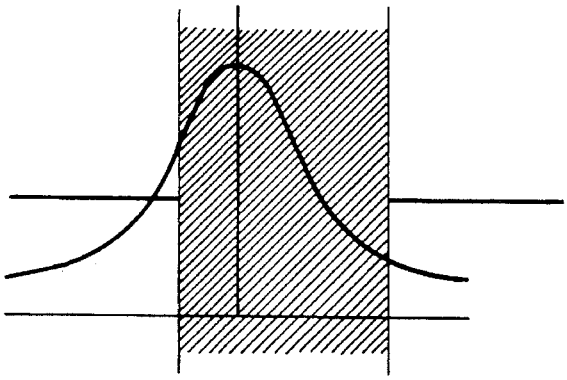
FIG. 15 is a view graphically representing a light transmission limited state of one of the two laser beams when the aperture is located at the position B in FIG. 13.
Figure 16:
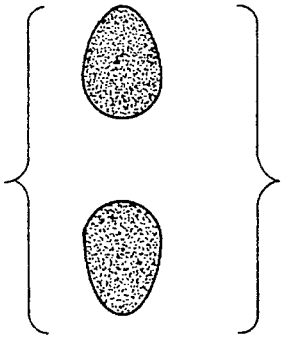
FIG. 16 is a view showing the imaging characteristic of each laser beam on the imaging surface when the aperture is located at the position B.

In the multi-beam scan optical system., the aperture must be located at a position denoted as A in FIG. 13. In the optical system of FIG. 13, which uses two laser beams, when the two laser beams pass through the aperture located at the position A, both the beams are symmetrically limited by the aperture irrespective of the size of the aperture. When the aperture is located at another position B, the laser beams are limited asymmetrically. The light intensity of the laser beam is distributed according to the Gaussian distribution as shown in FIG. 15. Therefore, one of the two laser beams, when passing through the aperture, is limited in a mode as shown in FIG. 15, while the other beam is limited in the inverted mode of FIG. 15. Therefore, the imaging characteristic of each beam on the imaging surface is not symmetrical as shown in FIG. 16. This has adverse effects on the image forming operation. The same thing is true for a multi-beam scan optical system using three laser beams as shown in FIG. 14. In FIG. 14, at a position A, a=b holds where a indicates the distance between the center of the light emitting face of the laser diode and the center of the collimate lens, and b indicates the distance between the center of the collimate lens and the center of the aperture. At this position, the laser beams intersect and cross the optical axis of the first scan optical system.

Figure 8:
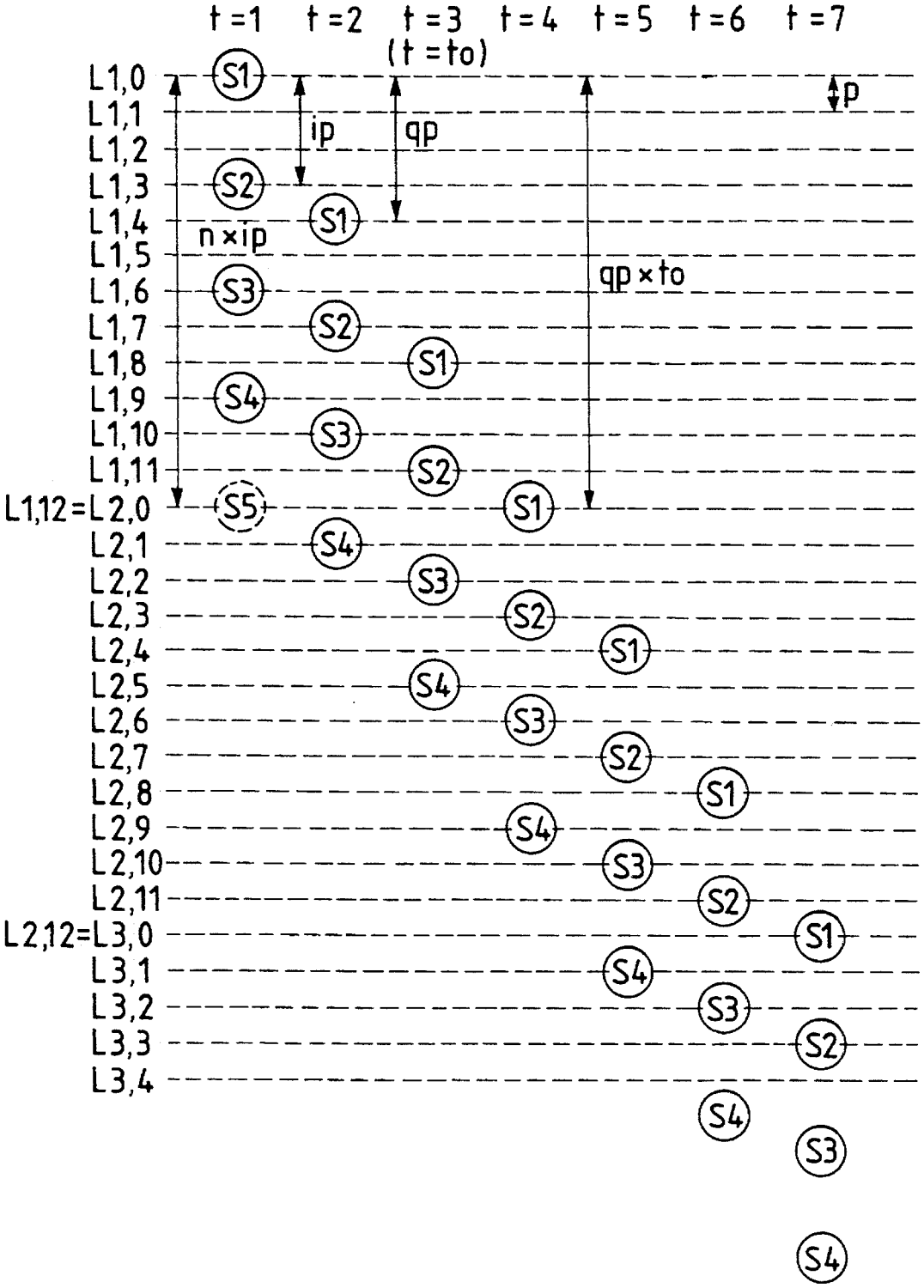
FIG. 8 PRIOR ART
FIG. 8 is an explanatory view depicting the relationship between the number of laser beams and the scan pitch on the photoreceptor surface in the conventional multi-beam scan optical system.
Figure 9:
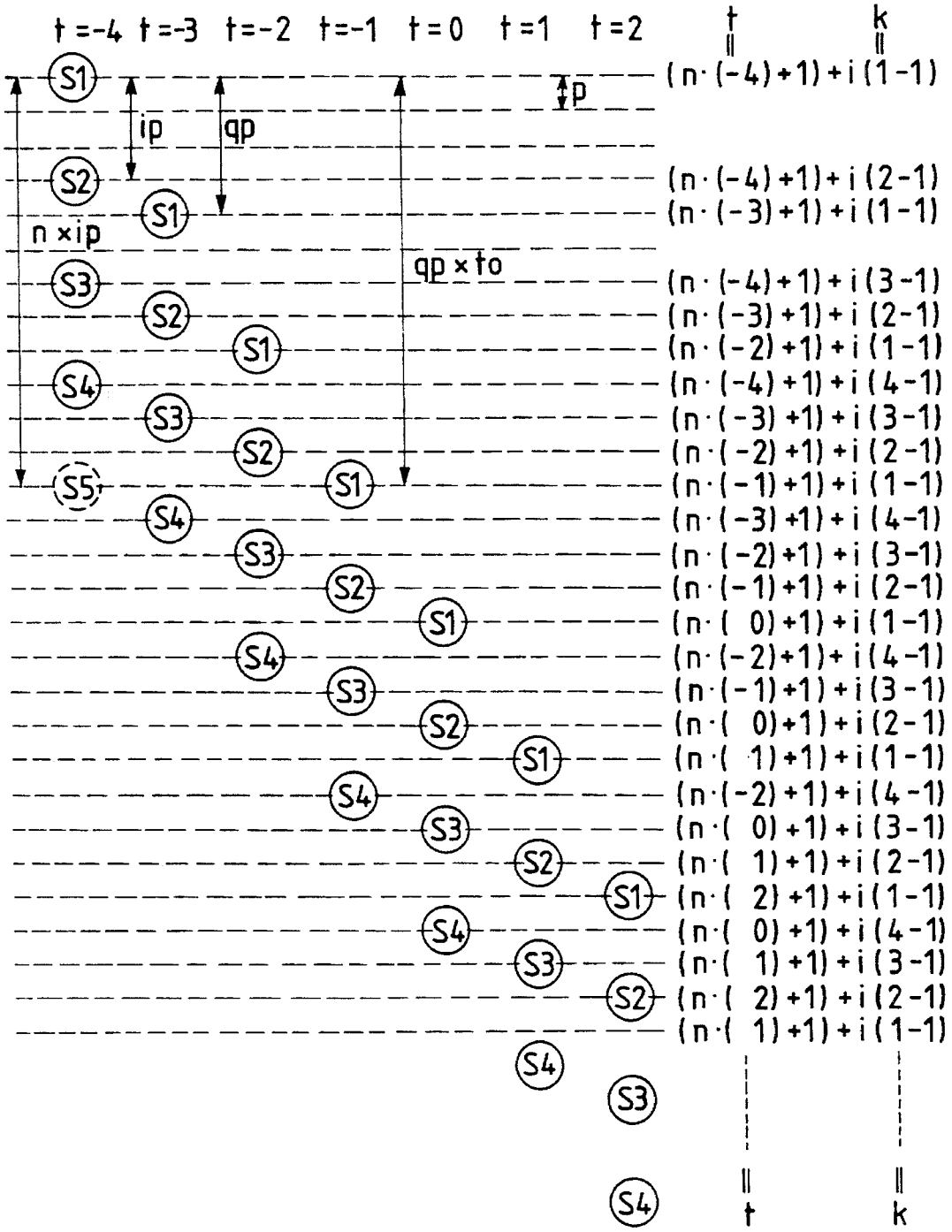
FIG. 9 is an explanatory view useful in explaining the conditions to realize the interlaced scanning.

A multi-beam scan optical system of which the K is within the range of 1.4 to 1.8 can be realized can easily be constructed by properly adjusting the parameters of the optical system components by the parameter setting method. Two or more laser beams may be used, as described referring to FIGS. 7, 8, and 9. A cylindrical mirror, in place of the cylindrical lens, may be used for the first subsidiary-scan directional power optical member 12. The cylindrical mirror for the second subsidiary-scan directional power optical member 16 may be substituted by a cylindrical lens, hologram element, or the like. If required, the mirror 13 is omissible.

In the multi-beam scan optical system according to the first aspect of the invention, K as the quotient of dividing the subsidiary-scan directional diameter of the spot of each laser beam on the photoreceptor surface by the width of a scan line (scan pitch), can be set to any of the values within the range of 1.4 to 1.8 in a manner that the parameters α, i, λ, $r_1$ and $\theta_1$ are selected so that $(4\alpha/\pi)i\lambda/r_1\theta_1$ takes a value within the range of 1.4 to 1.8.

Accordingly, a multi-beam scan optical system having the thus set K is excellent in the tone reproduction and linear image reproduction.

The foregoing description of preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A multi-beam scan optical system comprising:

a laser array including a plurality of laser diodes, said laser diodes having oscillation positions separated from each other by a distance $r_1$;

a rotating polygen mirror having facets;

a first scan optical system having an optical axis and including a collimate lens for collimating a plurality of laser beams emitted from the plurality of laser diodes, said collimated laser beams crossing the optical axis of the first scan optical system at a position, each of the laser beams emitted by the laser diodes having a divergence angle $\theta_1$ which corresponds to an angle within which an intensity of each of the plurality of laser beams is at least $1/e^2$ times a maximum intensity of each of the plurality of laser beams in a subsidiary scan direction and a wave length λ, a first subsidiary-scan directional power optical member, having an optical power in the subsidiary scan direction, for focusing the collimated laser beams on said facets of said rotating polygon mirror, and an aperture having a diameter and located at the position where the plurality of collimated laser beams cross the optical axis of said first scan optical system; and a second scan optical system including an f-θ lens disposed between the rotating polygon mirror and a photoreceptor surface, said f-θ lens receiving laser beams reflected from the rotating polygon mirror and emanating the received laser beams, and a second subsidiary-scan directional power optical member, having an optical power in the subsidiary scan direction, for focusing the laser beams emanated from said f-θ lens on the photoreceptor surface in a state that the laser beams are separated from each other by a given interlaced scanning period i in the subsidiary scan direction, wherein said parameters $r_1$, λ, $\theta_1$, and i are selected so as to satisfy the following relation:

$$K=\frac{4}{\pi}\ \alpha\ \frac{i\lambda}{r_1\theta_1}$$

where K is a number in a range from 1.0 to 1.8, and α is a value which depends on said diameter of the aperture as viewed in the subsidiary scan direction and satisfies the following relation:

$$d_2=(4\alpha/\pi)(\lambda f_2/D)$$

where π is a circular constant, $f_2$ indicates a focal distance of the first subsidiary-scan directional power optical member, D indicates a diameter in which the intensity is at least $1/e^2$ times the maximum intensity of each of the collimated laser beams entering the aperture, where $1/e^2$ is a constant, and $d_2$ indicates a spot diameter in the subsidiary scan direction of each of the laser beams which are focused on the facets of the rotating polygon mirror.

2. The multi-beam scan optical system according to claim 1, wherein $\alpha$ is selected within the following range;

$1.28 \leqq \alpha \leqq 1.94$.

3. The multi-beam scan optical system according to claim 1, wherein the interlaced scanning period i and a number n of the plurality of laser beams are mutually prime.

4. The multi-beam scan optical system according to claim 2, wherein the interlaced scanning period i and a number n of the plurality of laser beams are mutually prime.

* * * * *